US012686894B2

(12) United States Patent
Drelon

(10) Patent No.: US 12,686,894 B2
(45) Date of Patent: Jul. 21, 2026

(54) LANCE FOR BLOWING OXYGEN IN STEELMAKING

(71) Applicant: ArcelorMittal, Luxembourg (LU)

(72) Inventor: Benoît Drelon, Wormhout (FR)

(73) Assignee: ArcelorMittal, Luxembourg (LU)

( * ) Notice: Subject to any disclaimer, the term of this patent is extended or adjusted under 35 U.S.C. 154(b) by 576 days.

(21) Appl. No.: 18/030,096

(22) PCT Filed: Oct. 5, 2021

(86) PCT No.: PCT/IB2021/059121

§ 371 (c)(1),
(2) Date: Apr. 4, 2023

(87) PCT Pub. No.: WO2022/074555

PCT Pub. Date: Apr. 14, 2022

(65) Prior Publication Data

US 2023/0366052 A1 Nov. 16, 2023

(30) Foreign Application Priority Data

Oct. 6, 2020 (WO) ..... PCT/IB2020/059353

(51) Int. Cl.
*C21C 5/32* (2006.01)
*C21C 5/46* (2006.01)

(52) U.S. Cl.
CPC ..... *C21C 5/32* (2013.01); *C21C 5/4606* (2013.01); *C21C 2005/4626* (2013.01)

(58) Field of Classification Search
CPC . C21C 5/32; C21C 5/4606; C21C 2005/4626; C21C 5/305; F27D 2003/164; F27D 2003/168; F27D 2003/169; F27D 3/16; Y02P 10/20
USPC ..... 266/225
See application file for complete search history.

(56) References Cited

U.S. PATENT DOCUMENTS

| | | | | |
|---|---|---|---|---|
| 3,488,044 | A * | 1/1970 | Shepherd | C21C 5/4606 239/132.3 |
| 3,697,058 | A | 10/1972 | Chaikin et al. | |
| 3,730,505 | A | 5/1973 | Ramacciotti et al. | |
| 5,308,043 | A * | 5/1994 | Floyd | C21C 5/4613 266/89 |
| 5,599,375 | A | 2/1997 | Gitman et al. | |
| 5,681,526 | A | 10/1997 | Zhang et al. | |
| 5,865,876 | A | 2/1999 | Watkins et al. | |
| 5,885,323 | A | 3/1999 | Kim et al. | |
| 8,926,895 | B2 * | 1/2015 | Strelbisky | F27D 3/16 266/225 |
| 9,194,014 | B2 * | 11/2015 | Smith | C21C 5/4606 |
| 9,829,250 | B2 * | 11/2017 | Matusewicz | F27D 3/18 |

FOREIGN PATENT DOCUMENTS

| | | | |
|---|---|---|---|
| GB | 1349069 | A | 3/1974 |
| KR | 20200037950 | A | 4/2020 |

OTHER PUBLICATIONS

Search Report of PCT/IB2021/059121 of Nov. 23, 2021 and International Report on Patentability.

* cited by examiner

*Primary Examiner* — Jessee R Roe
*Assistant Examiner* — Michael Aboagye
(74) *Attorney, Agent, or Firm* — Davidson Kappel LLC

(57) ABSTRACT

A lance (1) for blowing oxygen onto a bath of molten steel including a tip (15) provided with first oxygen ejector (16) and a distributor (17) provided with second ejector (18).

13 Claims, 2 Drawing Sheets

LANCE FOR BLOWING OXYGEN IN STEELMAKING

The invention is related to a lance for blowing oxygen onto a bath of molten steel, and more particularly to a lance for post-combustion in steelmaking.

BACKGROUND

In steel-refining, the main starting materials are usually a mixture of liquid pig-iron and scrap. The quantity of scrap which can be added, i.e. the scrap addition or scrap rate, depends notably on the temperature of the liquid pig iron and on the quantity of heat generated in the converter by oxidation of chemical elements. Most of it concerns the transformation of carbon into carbon monoxide CO and then into dioxide $CO_2$. The more $CO_2$ is formed, the more heat is created and may be transferred to bath so as to provide energy for additional scrap melting. The transformation of CO to $CO_2$ is known as post-combustion.

Typically, with usual single oxygen flow, very little CO is post-combusted into $CO_2$ inside the vessel. By injecting a secondary flow of oxygen during the process, the unburned CO moving upward meets additional $O_2$ provided by this secondary flow and is then combusted into CO2. The reaction is defined by the commonly known equation: CO+½O2=CO2.

SUMMARY OF THE INVENTION

There are two different technologies which have been developed to provide the secondary flow of oxygen. The first one consists in having a single oxygen flow supply and then split it in a primary flux for standard decarburization and a secondary flow for enhancing post-combustion.

This first technology has the advantage of requiring few modifications of existing lances and for example to keep same lance diameter and weight, thus not impairing the overall support structure of the lance and reducing investment costs. A disadvantage is that the secondary flow rate of oxygen defined by the surface ratio between primary and secondary oxygen ejection means cannot be managed independently from the primary flow according to the process phases. Also, if oxygen supply is limited, primary oxygen flow is reduced, which impairs the decarburization process and productivity.

The second technology consists in having a double flow lance, wherein primary and secondary flows of oxygen have their own supply and are independently controlled. An example of a lance according to this technology is illustrated in U.S. Pat. No. 5,681,526. The main advantage of this technology is that primary and secondary flows of oxygen are independently controlled which allows more accurately control of the post-combustion process and thus an increase the post-combustion rate. A disadvantage of this technology is that it requires an overall change on the installation and thus high investment cost.

There is so a need for a lance allowing to perform a controlled post-combustion which can be easily implemented on existing installation and with a reduced investment cost.

The present invention provides a lance having an upper and a lower part and comprising a main tube for the supply of a primary flux of oxygen, a second tube surrounding the main tube to form a first annular gap for the circulation of cooling water within the lance, a third tube surrounding the second tube to form a second annular gap for the supply of a secondary flux of oxygen and extending only along the upper part of the lance, a fourth tube comprising a first part surrounding the third tube along the upper part of the lance and the second part surrounding the second tube along the lower part of the lance to form a third annular gap for circulation of cooling water within the lance, a tip, located at the end of the lower part of the lance, provided with at least one primary oxygen ejection mean for blowing the primary flux of oxygen which is designed to be in fluid connection with both first and third annular gaps to insure circulation of water within the lance, and a distributor making the junction between the upper and the lower part of the lance, said distributor being provided with at least one secondary oxygen ejection mean in fluid connection with the third gap for blowing the secondary flux of oxygen, the secondary oxygen ejection means being located at distance d above the primary oxygen ejection mean such as the ratio between the distance d and the internal diameter D of the converter is from 0.04 to 0.15.

The lance or the method of the invention may also comprise the following optional characteristics considered separately or according to all possible technical combinations:

- the ratio between the distance d and the internal diameter D of the converter 2 is from 0.08 to 0.15
- secondary oxygen ejection means of the distributor are located between 150 and 750 mm above the primary oxygen ejection means of the tip,
- the distributor is provided with sealing means preventing leakage of water,
- the distributor is mounted slidable around the fourth tube of the lance,
- the tip comprises at least four primary oxygen ejection means,
- the primary oxygen ejection means have a diameter comprised from 40 to 50 mm,
- the primary oxygen ejection means have a diameter comprised from 40 to 45 mm,
- the primary oxygen ejection means are designed so as to eject the primary flux of oxygen with an ejection angle $\alpha$ with the central axis Z of the lance from 10 to 20°,
- the primary oxygen ejection means are designed so as to eject the primary flux of oxygen with an ejection angle $\alpha$ with the central axis Z of the lance from 14 to 18°,
- the secondary oxygen ejection means have an oblong shape,
- the biggest width of the secondary oxygen ejection means is from 10 to 25 mm,
- the first annular gap 31 allows the entry of water into the lance and the third annular gap allows the exit of water from the lance.

The invention also relates to a steelmaking method using a lance according to anyone of the previous embodiments.

BRIEF DESCRIPTION OF THE DRAWINGS

Other characteristics and advantages of the invention will emerge clearly from the description of it that is given below by way of an indication and which is in no way restrictive, with reference to the appended figures in which.

DETAILED DESCRIPTION

Elements in the figures are illustration and may not have been drawn to scale.

Figure 1:
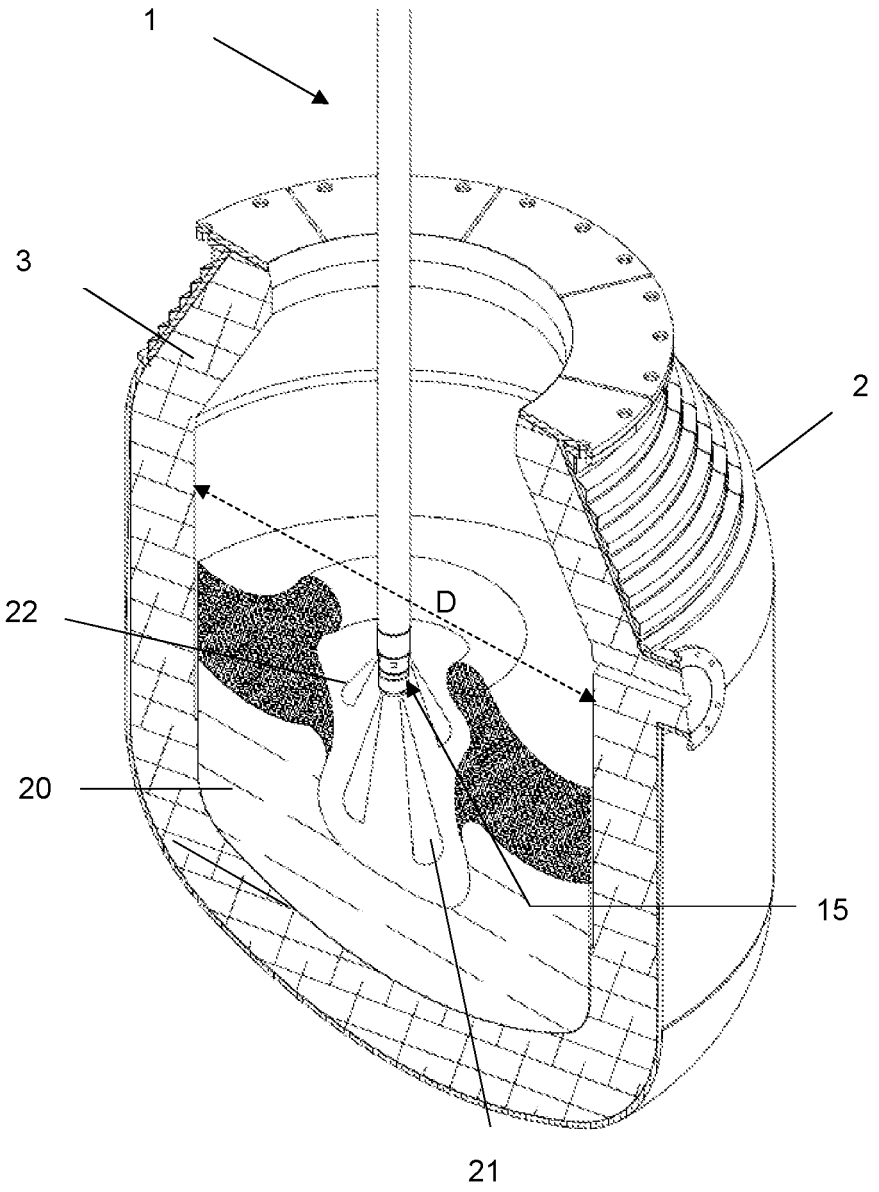
FIG. 1 illustrates a post-combustion method in a converter

FIG. 1 illustrates a converter 2 containing a bath of molten metal 20. The converter 2 is internally covered with a wall of refractories 3 and has a diameter D. The molten metal is pig iron which needs to be decarburized to produce steel. To perform such a decarburization, a lance 1 is inserted into the converter and blows a primary flux of oxygen 21 towards the molten metal 20 through an ejection means provided in the tip 15 of the lance. This decarburization allows removal of carbon from the bath as CO. In order to combust the unburned CO on the slag layer into $CO_2$, a secondary flux of oxygen 22 is injected towards the bath. This reaction is exothermic and releases a lot of energy which can be further used to melt scrap into the molten bath.

Figure 2:
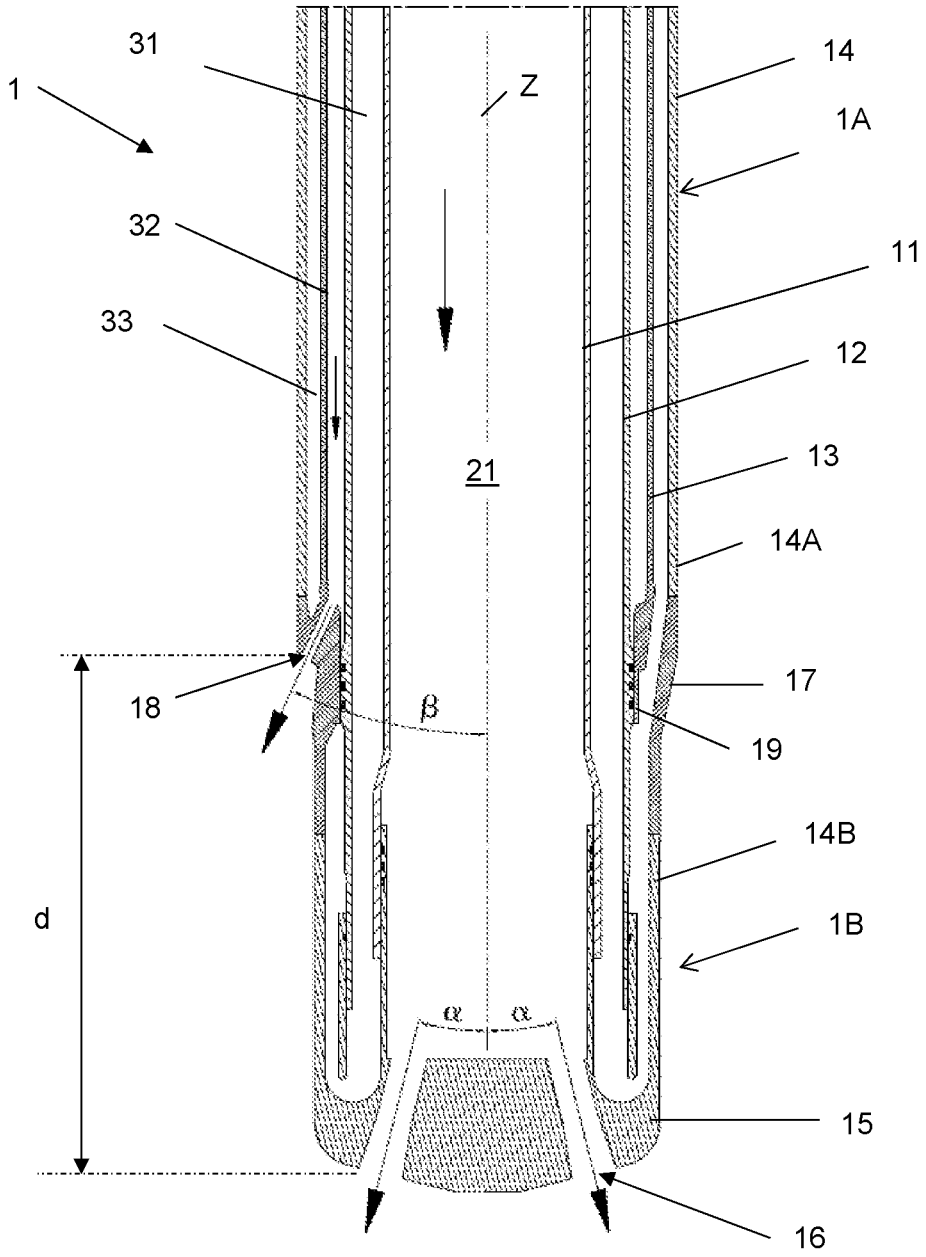
FIG. 2 illustrates a post-combustion lance according to an embodiment of the invention

This double oxygen ejection is performed with a post combustion lance, as the one illustrated in FIG. 2, according to one embodiment of the invention. As a purpose of information, such a lance is usually more than 20 meters long. The post-combustion lance 1 according to the invention comprises a plurality of tubes which surround one another and are concentric to a central longitudinal axis Z of the lance. The lance according to the invention is made of an upper part 1A and of a lower part 1B joined together by a distributor 17. The lower part 1B of the lance is the one closest to the bath 20 when inserted into the steelmaking vessel 2. The lance is composed of a first tube 11 which supplies the primary flux of oxygen 21, a second tube 12, which surrounds the main tube 11 thus forming a first annular gap 31 for the supply of cooling water within the lance 1. The lance being subjected to high temperature within the steelmaking process needs to be constantly cooled down so as to avoid being quickly damaged. Those two first tubes go along the whole length of the lance, each in a single part, which allows reduction of risks of tightness issues. The first tube 11 is preferentially made of a material allowing the passage of a flow at a speed of at least 60 m/s, such as stainless steel.

The lance 1 then comprises a third tube 13, surrounding the second tube 12 to form a second annular gap 32 for the supply of the secondary flux of oxygen 22 necessary for the post-combustion. This third tube does not extend all along the length of the lance 1 but only along the upper part 1A. This third tube is preferentially designed so that there is a ratio of 1/5 between the section of the gap for the circulation of the primary of oxygen and the section of the gap for the circulation of the secondary flux of oxygen. The lance comprises then a fourth tube 14, comprising a first part 14A, which surrounds the third tube 13 along the upper part 1A of the lance, and a second part 14B surrounding the second tube 12 along the lower part 1B of the lance. This fourth tube 14 thus forms a third annular gap 33 allowing the drawing off of the cooling water. In another embodiment, the first annular gap 31 may be designed to drawn off the cooling water from the lance 1 while the third annular gap 33 allows the entry of the water within the lance 1.

The lance 1 further comprises a tip 15, closing the lower part of the lance 1B. This tip is in fluid connection with both first and third annular gaps so as to close the water circuit and provide circulation of water within the lance. This furthermore allows the cooling down of the tip 15 itself which is the closest part to the molten steel and thus subjected to the highest temperatures. The tip is provided with at least one primary oxygen ejection means 16 for blowing primary flow of oxygen 21 onto the bath of molten steel and allowing decarburization. In a preferred embodiment the tip is provided with at least four primary oxygen ejection means 16, the optimal number depending notably of the size of the ladle and thus of the circumference of the molten bath. The diameter of the primary oxygen ejection means depends on the same parameters. In a preferred embodiment, those primary oxygen ejection means 16 have a diameter comprised between 40 and 50 mm, preferentially between 40 and 45 mm. In a preferred embodiment these ejection means are designed so as to eject the primary flux of oxygen with an ejection angle $\alpha$ with the central axis Z of the lance 1 comprised between 10 and 20°, preferentially between 14 and 18°. This allows to find a good compromise between maximization of the surface of the molten bath receiving oxygen ang keeping sufficient distance from the refractories walls to avoid damaging them.

The lance is designed to receive a distributor 17 making the junction between the upper 1A and the lower part 1B of the lance and ensuring the circulation of water between the upper 14A and the lower 14B parts of the fourth tube. This distributor 17 is provided with at least one secondary oxygen ejection means 18 in fluid connection with the third tube 13 for blowing the secondary flux of oxygen 22 onto the bath of molten steel. This secondary flux of oxygen will provide necessary fuel for the further combustion of CO and the release of additional energy for scrap melting. In a preferred embodiment the distributor 17 is provided with the same number of secondary ejection means 18 as the number of primary ejection means 16 provided on the tip 15. These ejection means 18 may have exits with a diameter comprised between 10 and 25 mm. Said exits may have an oblong or circular shape. Secondary oxygen ejection means 18 are located at a distance d above the primary oxygen ejection means 16 of the tip 15 such as the ratio (d/D) between the distance d and the internal diameter D of the converter 2 is from 0.04 to 0.15, preferentially from 0.08 to 0.15. They may be located between 500 and 750 mm above the first oxygen ejection means 16 of the tip 15. This distance d between both ejection means allows to enhancement of the efficiency of the secondary flux of oxygen by promoting the mixing of CO and O2 into the bath.

In a most preferred embodiment the distributor is mounted on the lance 1 so as to be able to slide of few centimetres, less than 5 cm, along the pipe 12 in order to follow the thermal expansion of the external tube 14 due to thermal constraints it is subjected to. This is done by appropriate means, such as O-rings 19. The distributor is furthermore provided with sealing means preventing water leakage in the annular gaps supplying the oxygen flows. These sealing means are for example O-rings.

With the lance according to the invention it is possible to insert the third tube 13 within the others and thus the external diameter of the lance is not increased compared to existing lance and there is thus no need to replace the overall supporting structure of the lance which reduce investment costs for the post-combustion process. Moreover, the secondary flux of oxygen crosses only once the water circulation channels, which allows limiting of the water pressure losses compared to prior art combustion lances. Finally, with the lance according to the invention, risks of tightness issues are limited.

What is claimed is:

1. A lance for blowing oxygen to a bath of molten steel contained in a converter, the lance defining an upper part and a lower part, the lower part being closer to the bath of molten steel, the lance comprising:

a main tube for supply of a primary flux of oxygen;

a second tube surrounding the main tube to form a first annular gap for the circulation of cooling water within the lance;

a third tube surrounding the second tube to form a second annular gap for supply of a secondary flux of oxygen, the third tube extending only along the upper part of the lance;

a fourth tube having a first part surrounding the third tube along the upper part of the lance and having a second part surrounding the second tube along the lower part of the lance, to form a third annular gap for circulation of cooling water within the lance;

a tip, located at an end of the lower part of the lance, provided with at least one primary oxygen ejector for blowing the primary flux of oxygen to the bath of molten steel and being designed to be in fluid connection with both the first and third annular gaps to ensure circulation of water within the lance;

a distributor forming a junction between the upper and the lower part of the lance, the distributor having at least one secondary oxygen ejector in fluid connection with the second annular gap for blowing the secondary flux of oxygen, the at least one secondary oxygen ejector of the distributor being located at distance d above the at least one primary oxygen ejector of the tip so that a ratio between the distance d and an adjacent internal diameter D of the converter is from 0.04 to 0.15.

2. The lance as recited in claim 1 wherein the ratio is from 0.08 to 0.15.

3. The lance as recited in claim 1 wherein the at least one secondary oxygen ejector is located from 150 to 750 mm above the at least one primary ejector.

4. The lance as recited in claim 1 wherein the distributor has a seal preventing leakage of water.

5. The lance as recited in claim 1 wherein the distributor is mounted slidably around the fourth tube.

6. The lance as recited in claim 1 wherein the at least one primary ejector includes at least four primary oxygen ejectors.

7. The lance as recited in claim 1 wherein the at least one primary ejector has an exit diameter from 40 to 50 mm.

8. The lance as recited in claim 7 wherein the at least one primary oxygen ejector has an exit diameter from 40 to 45 mm.

9. The lance as recited in claim 1 wherein the at least one primary oxygen ejector is designed so as to eject the primary flux of oxygen with an ejection angle with respect to a central axis of the lance from 10 to 20°.

10. The lance as recited in claim 1 wherein the at least one primary oxygen ejector is designed so as to eject the primary flux of oxygen with an ejection angle with respect to a central axis of the lance from 14 to 18°.

11. The lance as recited in claim 1 wherein the at least one secondary oxygen ejector has an exit with an oblong shape.

12. The lance as recited in claim 1 wherein a biggest dimension of an exit of the at least one secondary oxygen ejector is from 10 to 25 mm.

13. The lance as recited in claim 1 wherein the first annular gap allows entry of water into the lance and the third annular gap allows exit of water from the lance.

* * * * *